US005647428A

United States Patent [19]

Echols

[11] Patent Number: 5,647,428

[45] Date of Patent: Jul. 15, 1997

[54] RECOVERY OF TUBE CLEANERS

[75] Inventor: James F. Echols, Bellaire, Tex.

[73] Assignee: BetzDearborn Inc., Trevose, Pa.

[21] Appl. No.: 496,142

[22] Filed: Jun. 28, 1995

Related U.S. Application Data

[63] Continuation-in-part of Ser. No. 262,855, Jun. 21, 1994, Pat. No. 5,473,787.

[51] Int. Cl.[6] ..... F28G 1/12

[52] U.S. Cl. ..... 165/95; 15/3.51; 134/104.3

[58] Field of Search ..... 165/95; 15/3.51; 134/104.3

[56] References Cited

U.S. PATENT DOCUMENTS

| | | | |
|---|---|---|---|
| 2,801,824 | 8/1957 | Taprogge | 165/95 |
| 3,021,117 | 2/1962 | Taprogge | 165/95 |
| 3,269,543 | 8/1966 | Treplin . | |
| 4,113,008 | 9/1978 | Treplin et al. . | |
| 4,135,574 | 1/1979 | Treplin et al. . | |
| 4,234,993 | 11/1980 | Kintner . | |
| 4,283,807 | 8/1981 | Bizard . | |
| 4,304,295 | 12/1981 | Otake . | |
| 4,350,202 | 9/1982 | Schulz et al. . | |
| 4,385,660 | 5/1983 | Koller . | |
| 4,523,634 | 6/1985 | Bizard . | |
| 4,688,630 | 8/1987 | Borchert . | |
| 4,696,318 | 9/1987 | Smith | 134/73 |
| 4,830,099 | 5/1989 | Eimer . | |
| 5,010,950 | 4/1991 | Voith . | |
| 5,086,833 | 2/1992 | Ben-Dosa | 165/95 |
| 5,433,229 | 7/1995 | Blair | 134/104.3 |

FOREIGN PATENT DOCUMENTS

| | | | |
|---|---|---|---|
| 4029437 | 5/1992 | Germany | 165/95 |

OTHER PUBLICATIONS

Brackett Green sales brochure "Vertically Inclined Raked Screens". Date Unknown.

FMC sales brochure, Date Unknown.

T.D. Kolfat, "Cooling Tower Practices," *Power Engineering,* Jan. 1974, pp. 32–39.

R. Burger, "Counterflow and Crossflow Cooling Towers," *Plant Engineering,* Jan. 19, 1978, pp. 137–139.

"What's happening in the world of cooling towers," *Power,* Dec. 1985, pp. S–2 –S–7.

S.D. Strauss, "Cooling Water Treatment," *Power,* Jun. 1984, pp. S–1 –S–24.

"Performance of Mechanical Systems for Condensor Cleaning," Electric Power Research Institute, EPRI CS–5032, Project 2300–11, Jan. 1987.

*Primary Examiner*—Leonard R. Leo

*Attorney, Agent, or Firm*—Alexander D. Ricci; Steven D. Boyd

[57] ABSTRACT

Apparatus and method are provided for removing hard-body cleaners from cooling water downstream of a heat exchanger. The bodies are removed from the cooling water by a screen placed such that water flowing in and out of a container which is open to the atmosphere flows through the screen. Bar rake screens, traveling screens or other stationary forms of screens may be used. The cleaning bodies are removed from the screen by mechanical, gravity or fluid flow forces, and then may be recirculated to a heat exchanger.

2 Claims, 5 Drawing Sheets

FIG.4
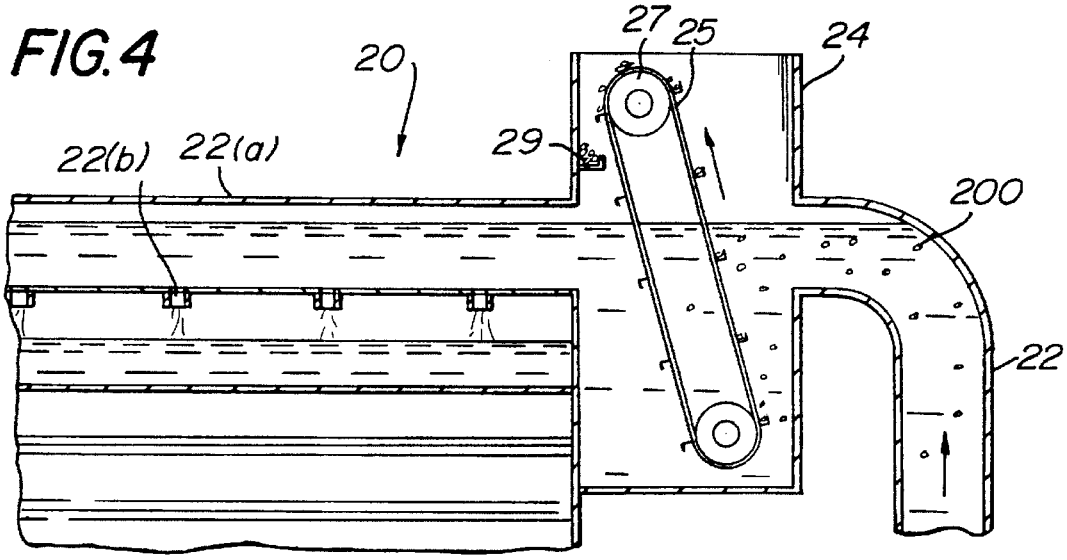
FIG.5
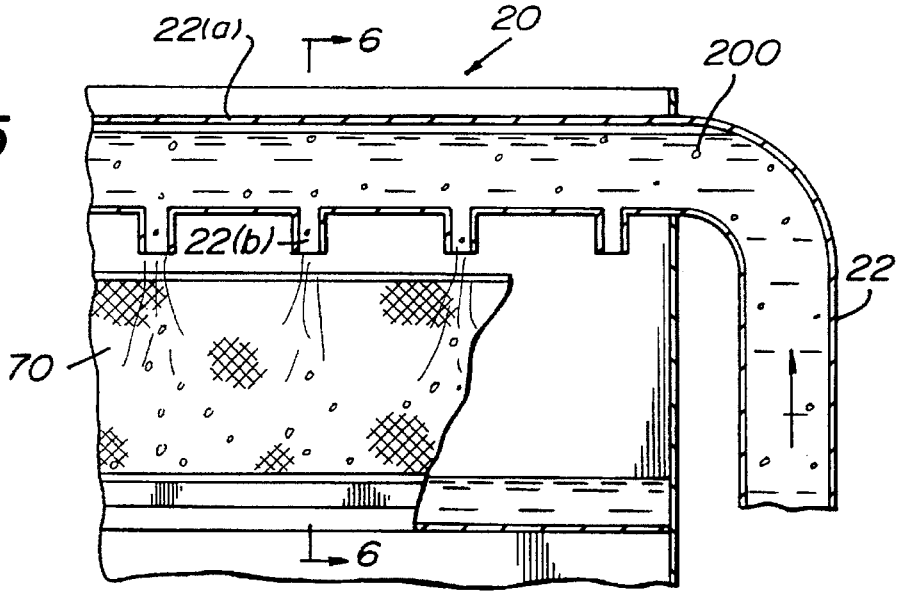
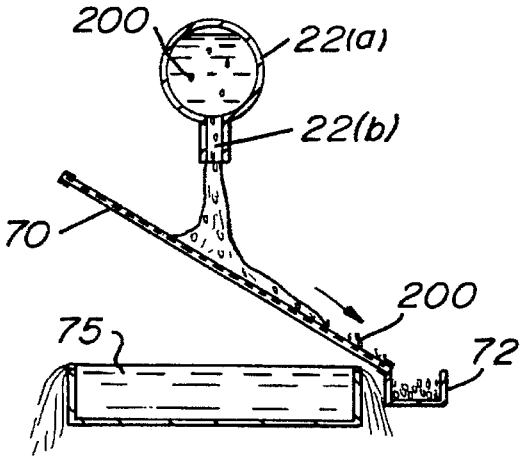
FIG.6

FIG.7
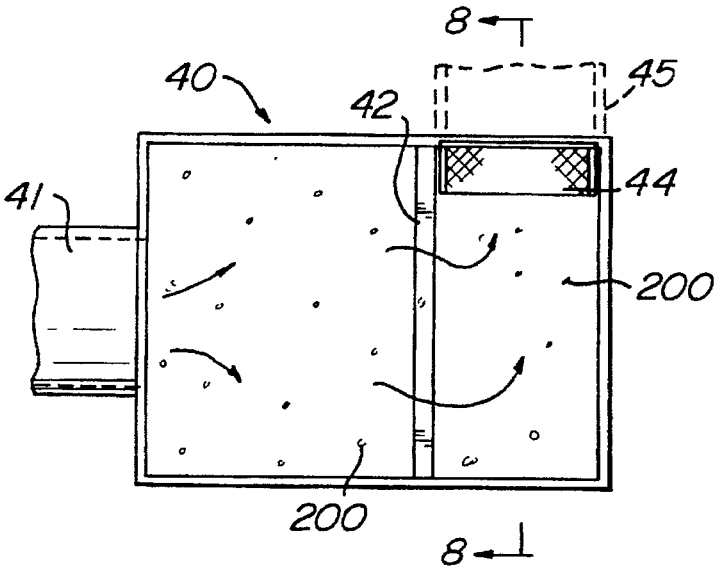
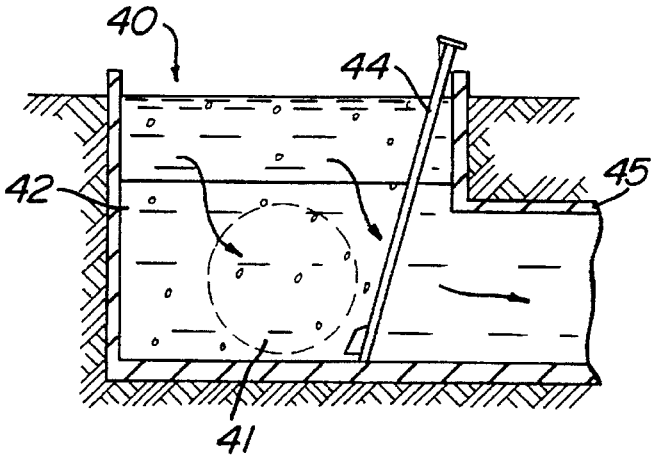
FIG.8
FIG.12
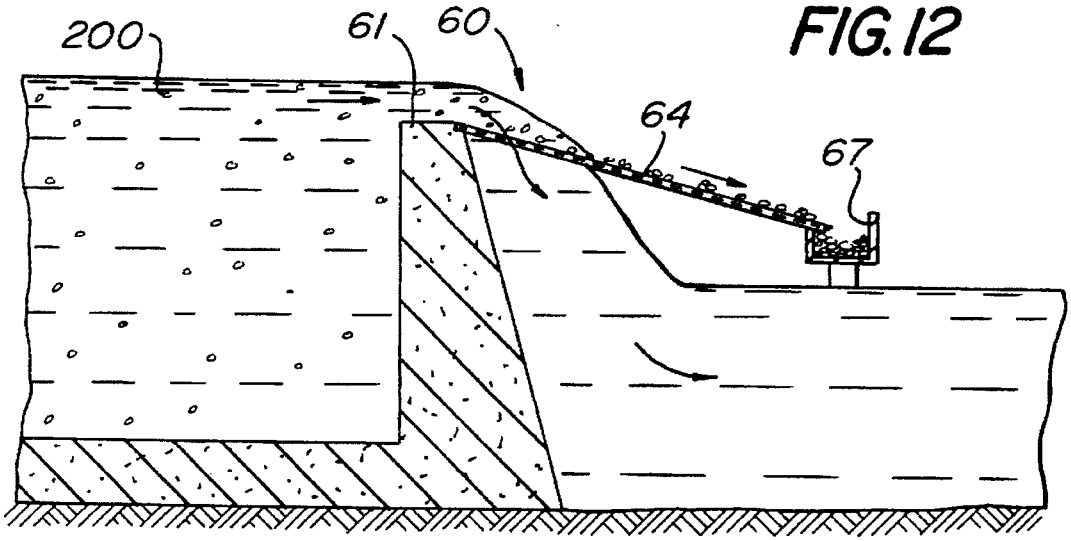

RECOVERY OF TUBE CLEANERS

This is a continuation-in-part of application Ser. No. 08/262,855, filed Jun. 21, 1994, now U.S. Pat. No. 5,473,787.

SPECIFICATION

1. Field of the Invention

This invention relates to the cleaning of the tubes of heat exchangers. More particularly, method and apparatus are provided for recovering tube cleaners utilizing open screening devices.

2. Background of the Invention

Heat exchangers are necessary components of many industrial processes. A common form of heat exchanger is a shell through which a large number of tubes pass, the shell enclosing the fluid to be cooled and the tubes conducting a coolant for removing the heat. Such heat exchangers are commonly used in refining, petrochemical and power generation industries. In particular, in steam power plants, the steam condenser employs cooling water passing through many thousands of heat exchanger tubes. After steam has passed through a turbine, it is condensed in the shell of the heat exchanger. The efficiency of heat removal from the steam by the cooling water determines the back pressure at the turbine exhaust, and this pressure significantly affects the total energy extracted from the steam. Energy lost by not extracting it from the steam leads directly to an increase in power generation costs.

To maintain maximum heat transfer efficiency in a tube and shell heat exchanger, it is necessary to minimize buildup of a film, such as a bio-growth or a chemical scale, on the internal surface of the tubes of the heat exchanger. Chemical and mechanical treatments are used. "On-line" and "off-line" mechanical techniques have been used for removing such buildups. On-line techniques, in which the heat exchanger is not taken out of service as the tubes are cleaned, are the subject of this invention.

There are several types of cooling water systems. In "once-through" systems, the cooling water passes through the heat exchange equipment only once. The warmed water is discharged—often to its original source: a river, lake, well or the ocean. Another type of cooling water system is a closed recirculating system. The cooling water in this system is completely confined within the system pipes and heat exchangers. The heat is generally dissipated by heat exchange with air. Another type of cooling water system is an open recirculating cooling tower system. The water is continuously reused as in the closed system, with makeup water added, but the system is open to the atmosphere in a cooling tower. Another type of system is called an "open loop" system. In this system a body of water is open to the atmosphere. The body of water may be a large body, such as a lake or pond. The once-through, open recirculating cooling tower system and the open loop systems will be referred to as "once-through or open loop" (herein "OTOL") systems. The OTOL systems have the greatest potential for buildup of films inside heat exchanger tubes, either from biofouling or scale, and this is the type of cooling water systems to which the present invention applies.

Cooling towers, a component of many cooling water systems, are designed in many different configurations. Common to all is a means for forming a large surface area between cooling water and the air. Air is then drawn through the dispersed liquid—in a horizontal direction in cross-flow cooling towers and in a vertical direction in counterflow cooling towers. The air may be driven by natural draft and a large chimney, such as the hyperbolic towers commonly associated with nuclear power plants, or by mechanical drivers—normally fans driven by electric motors. In a cooling tower, the water is pumped to a level where it falls by gravity, either through orifices or spray nozzles, and creates droplets or a splash zone. Means are provided for dispersing the water over the area of the "fill" through which it will fall. This dispersal may be through conduits into a pan or open basin or through a flume. This open surface in a cooling tower provides a body of water open to the atmosphere, albeit a small body, as is present in other OTOL systems.

Cleaning of the tubes of heat exchangers while on-line by pumping sized solid bodies through the tubes has long been practiced. The original U.S. patent by Taprogge (U.S. Pat. No. 2,801,824) describes such a system. In this method, deformable spheres made of foamed elastomer are pumped through the tubes and recovered downstream of the heat exchanger. There is a considerable body of art, such as, for example, that described in U.S. Pat. 4,830,099, related to apparatus for removing such deformable cleaning bodies from cooling water downstream from the heat exchanger. These devices involve screens in a particular configuration which separate the deformable cleaning bodies from the flow, with the cleaners removed from the screens by additional suction means. Such devices are used as an integral part of a conduit or closed flow stream immediately downstream of the heat exchanger. A conduit carrying the cooling water is sealed to the inflow and to the outflow openings of such enclosed screening devices. There is no water surface open to the atmosphere associated with the removal of the cleaning bodies from the cooling water, either at the inflow or outflow side of the screens.

In recent years, a new type of on-line tube cleaner has been described, which is called a "hard-body" type cleaner. These cleaners have a body which is generally spheroidal in shape and made of a material such as polypropylene plastic. Attached to the body is a flexible disk of plastic such as polyurethane which is designed to wipe and clean the inside wall of a heat exchanger tube as the body is pumped through the tube. Improvements in hard-body tube cleaners are the subject of my co-pending application, Ser. No. 08/262,855, which is incorporated herein by reference.

U.S. Pat. No. 4,696,318 discloses a system which can be used to remove "hard-body" type (i.e., non-deformable) cleaning bodies from open recirculating cooling water systems. The removal is accomplished by adjusting the density of the cleaning bodies such that they float and then recovering them by skimming from a stream downstream of the steam condenser of a power plant. A stream suitable for recovering hard-body cleaners utilizing the flotation method of recovery. is not available in many power plants. In some plants, excess turbulence in the stream prevents successful recovery by flotation. As a consequence, skimming can be used in only about twenty percent of power plants.

What is needed is apparatus and method for recovering hard-body tube cleaners from cooling water downstream of heat exchangers in once-through, open recirculating cooling tower and open loop systems where flotation is not a suitable or preferred method of recovery. The apparatus and method should avoid the high cost and pressure loss associated with the screens now used for recovery of deformable cleaning bodies, and should take advantage of the open water surfaces available in or around some cooling water systems so as to make possible access to the screening devices used and allow usage of a broader range of screening devices.

SUMMARY OF THE INVENTION

Apparatus and method are provided for removing cleaning bodies from the cooling water downstream of a heat exchanger where an open surface of the cooling water exists. A screening device is placed such that cooling water entering and leaving a container having the open surface passes through the screening device. In one embodiment, the screening device is a bar screen having a rake to remove the cleaning bodies from the screen so that they can be recirculated back to a heat exchanger. In another embodiment, the screening device is a traveling screen. In another embodiment the screening device is a rotary drum screen. Other types of screening devices which are used for removing solids from large volumes of intake water are suitable. The screening device may be placed in a flume of cooling water which is used to distribute water around a cooling tower, upstream of the distribution conduits in a cooling tower, in a seal pit or discharge structure of a power plant, in a stream falling in elevation as it leaves a power plant or in any other where an open surface of the cooling water is present. In a preferred embodiment, opening size of the screen of the screening device is from about 45 percent to about 90 percent of the size of the inside diameter of the tubes to be cleaned.

BRIEF DESCRIPTION OF THE DRAWINGS

FIG. 4 is a sketch of one embodiment of a moving screen for recovery between the riser and distribution piping of a cooling tower.

FIG. 5 is a view of a sloped screen for recovery in a cooling tower.

FIG. 6 is an alternate view of the sloped screen of FIG. 5 for recovery in a cooling tower.

FIG. 7 is a top view of a recovery screen placed in a seal pit.

FIG. 8 is a side view of a seal pit and recovery screen placed in the seal pit.

FIG. 12 is a cross-section of one embodiment of an open-surface recovery screen attached to a weir.

DETAILED DESCRIPTION OF PREFERRED EMBODIMENT

Figure 1:
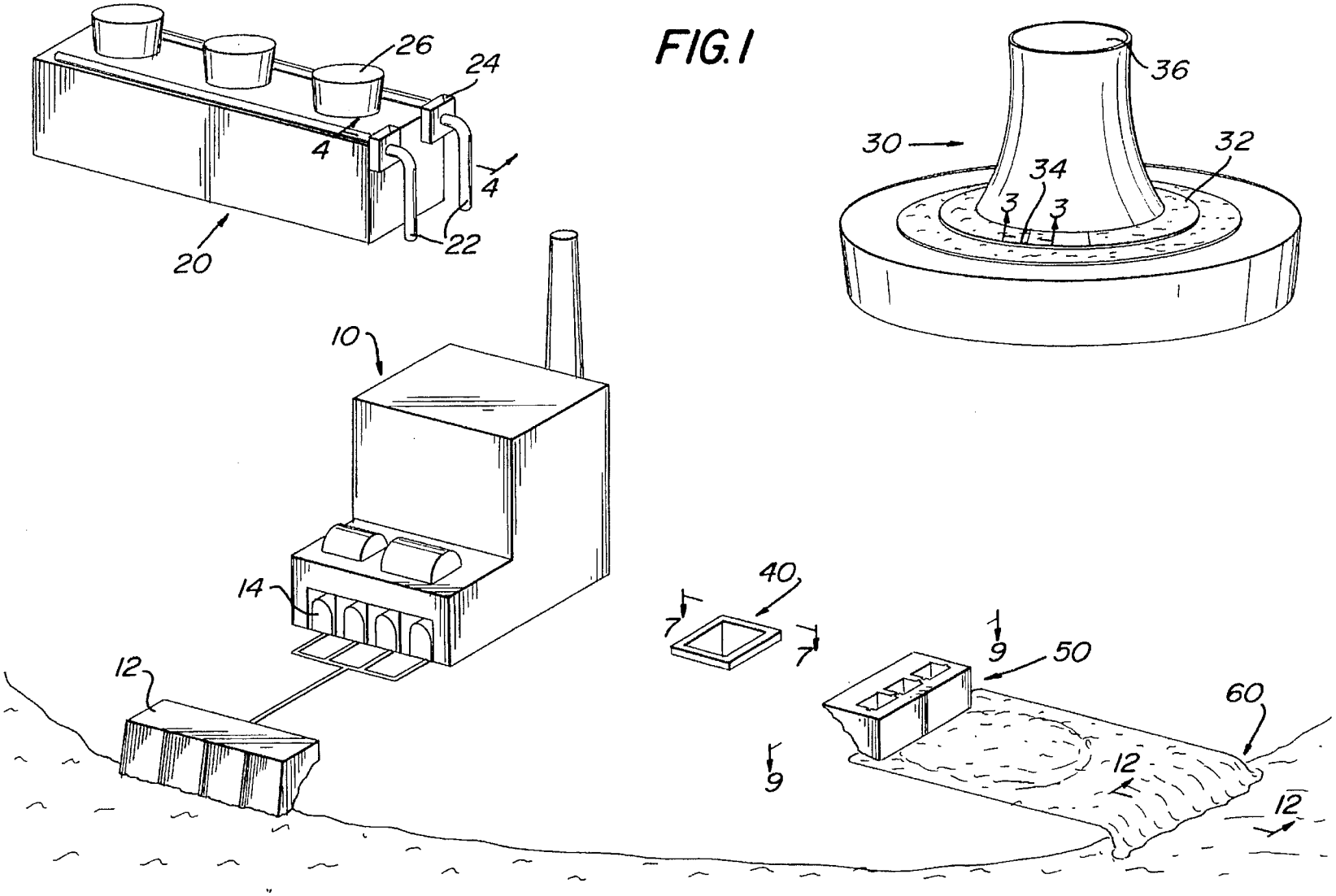
FIG. 1 is a sketch of a power plant and various components of a cooling water system showing some common open water surfaces where recovery screens may be placed.

Referring to FIG. 1, power plant 10 has cooling water intake structure 12 and shell-and-tube heat exchangers 14. The inside surface of the tubes of heat exchanger 14 are to be mechanically cleaned while power plant 10 is on-line by passing hard-body cleaners through the tubes of heat exchanger 14. The figure includes several components of the cooling water system where the hard-body cleaners may be recovered. Not all these components will necessarily be present in any one power plant.

The cleaners may be recovered from cooling water passing to mechanical draft cooling tower 20. Hot water is piped to cooling tower 20 through risers 22. Inlet box 24 is placed downstream of risers 22 and ahead of the water distribution system (not shown) in cooling tower 20. Air is forced through cooling tower 20 by fans (not shown) and exhausts through chimneys 26. As indicated in FIG. 1, FIG. 4 will show a cross-section of inlet box 24 and risers 22.

The cleaners may also be recovered from the cooling water passing through hyperbolic cooling tower 30. Flume 32 receives cooling water and distributes the water in flume 32 which passes around chimney 36. Screen 34 is placed so as to remove the bodies from flume 32. As indicated in the figure, FIG. 3 will show a cross-section of screen 34 in flume 32.

The cleaners may also be recovered in the cooling water passing through seal pit 40. A seal pit is present in some power plants to insure that the discharge piping from the heat exchangers is always covered with water. The open surface of water in a seal pit provides a location for practicing this invention. As shown in the figure, a cross-section is shown in FIG. 7 of one embodiment of a screen device for recovering cleaners from a seal pit.

Figure 9:
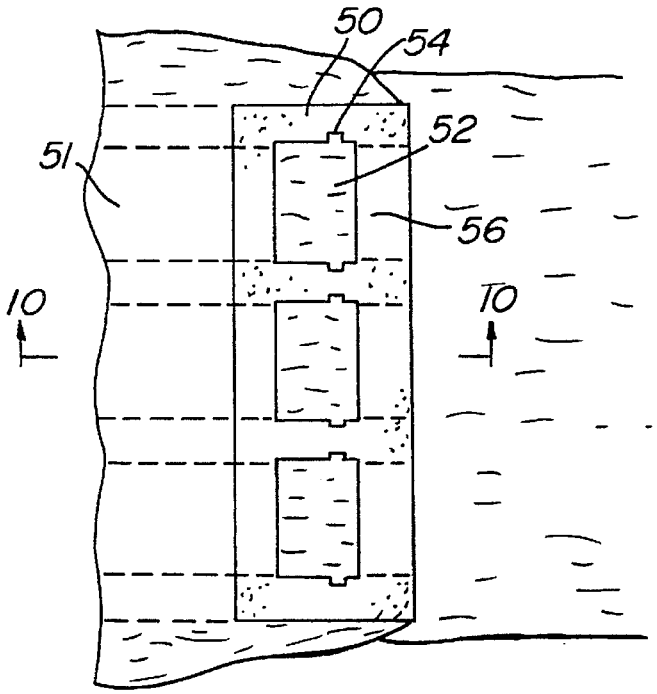
FIG. 9 is a top view of a discharge structure having an open surface and recovery screens.

The cleaners may also be recovered from discharge structure 50 of power plant 10. Discharge structure 50 includes open surfaces of water and normally includes slots (not shown) for "stop logs," which are inserted to seal a conduit from the structure. As indicated in the figure, a cross-section is shown in FIG. 9 illustrating one embodiment of a screen device for recovering cleaners from a discharge structure.

The cleaners may also be recovered as the discharge water flows to a lower elevation over structure 60. Elevation changes of the heated water are present in some power plants before the water is discharged back to a body of water from which it may or may not be recirculated. As indicated in the figure, a cross-section is shown in FIG. 12 of such an elevation change.

Figure 2:
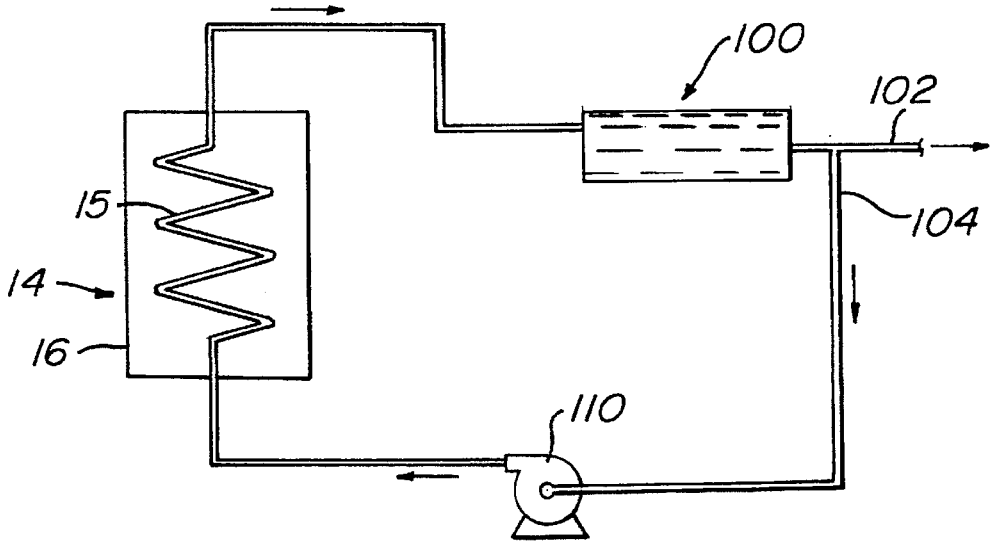
FIG. 2 is a schematic of a once-through or open loop (OTOL) cooling water system.

Referring to FIG. 2, heat exchanger tubes 15 are contained within shell 16 of heat exchanger 14. Cooling water is conveyed to container 100 in which the surface of the water is open to the atmosphere. Container 100 may be, for example, an inlet box or distribution vessel or flume in a cooling tower, a seal pit, a discharge area from a plant or any other container in which the surface of the water is open to the atmosphere. In a once-through system. outflow line 102 conveys the cooling water to discharge in a body of water, such as a river or the sea, from which it is not recirculated. Alternatively, discharge line 104 may convey the cooling water back to heat exchanger 14. Pump 110 supplies pressure for recirculation of the water. If the outflow is recirculated back to heat exchanger 14 by pump 110, the cooling system is referred to as an "open loop." The combination is called a "once-through or open loop" ("OTOL") system.

Figure 3:
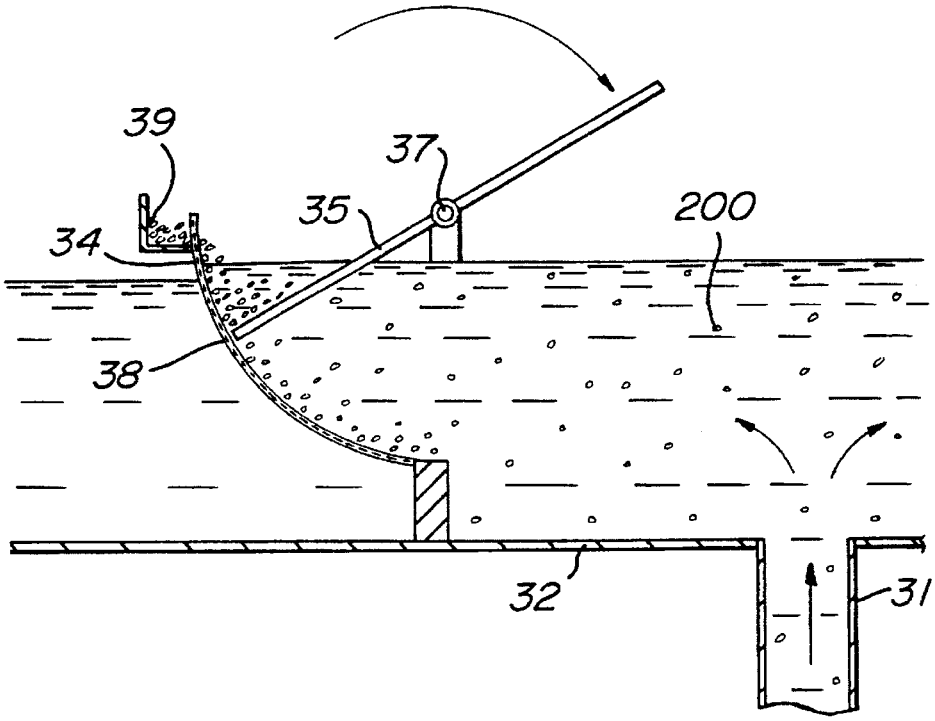
FIG. 3 is s sketch of one embodiment of an open-surface recovery screen for use in the flume above the fill of a cooling tower.

FIG. 3 shows a particular configuration for recovery of tube cleaners from an open container such as the open container 100 of FIG. 2. The cross-sectional view shown in FIG. 3 is indicated in FIG. 1 as being in flume 32 passing around a hyperbolic cooling tower 30. In FIG. 3, tube cleaners 200 are dispersed in the cooling water flowing through plume 32. Screen 34 has been placed so as to intercept cooling water near inlet conduit 31. A second screen (not shown) would be similarly placed to intercept flow in the opposite direction from inlet conduit 31. Arm 35 supported by pivot 37 is disposed so as to remove tube cleaners from screen 34 and place them in trough 39, from which they are flushed by water back to a pump (not shown) for recirculation through a heat exchanger.

Screen 34 may be curved as shown in FIG. 3, or may be straight, and preferably is of the construction similar to a "pivoted skip raked bar screen," but may be any of a wide variety of screens available for screening solids from large volumes of water. In a preferred embodiment, screen 34 is a bar screen which is raked by rake 38 attached to arm 35. Alternatively, screen 34 may be of the construction of a "travelling screen." As shown in FIG. 3 for a pivoted skip raked bar screen, the rake mechanism removes cleaning bodies or cleaners 200 to trough 39, though which the bodies are recirculated to the inlet water to a heat exchanger.

Pivoted skip rake bar screen devices are available, for example, from Brackett Green of Colechester, Essex, England, or through the offices of Brackett Green U.S.A., Inc. in Houston, Tex. travelling screens are available, for example, from FMC Corporation of Colemark, Pa. Such devices are well known in the art of water treatment. They are commonly used for removing solids and debris from intake raw water before it is used in industrial processes. In these applications, the water is taken from a body of water having its surface open to the atmosphere, and the water flows through the screen only by the difference in head or level of the water between the upstream and downstream sides of the screen. Although illustrations herein show skip rake bar screens, traveling screens and slanted stationary screens, the method of this invention is not limited to any particular configuration or type of screening devices designed for removing solids from water as the water having a surface open to the atmosphere flows through the screen of the screening device.

When hard-body cleaners are being removed, screen opening size is selected to be from about 35 percent to about 90 percent of the size of the exterior dimension of the hard-body component of the cleaners. The size of the hard-body cleaners will be determined by the diameter of the heat exchanger tubes to be cleaned. Preferably, screen opening size is selected to be from about 45 percent to about 90 percent of the size of the inside diameter of the tubes to be cleaned. One of the advantages of hard-body cleaners is that the spacing of the bars or screens for removing the cleaners may be larger than that conventionally used with the deformable cleaning bodies of the prior art. For example, for a 20 mm ID tube, sponge balls having a diameter of about 22 mm would be used, and the screen opening to remove these balls would be in the range of 7 mm. For a hard-body cleaner to clean the same size tube, the exterior diameter would be about 18 mm and the bar spacing could be about 14 mm, or approximately twice that required for the sponge ball. This allows the use of a screening device having lower differential pressure across the screen than the pressure differential which normally exists when deformable cleaners are recovered.

The method of this invention also makes possible much larger surface area of the screening device to be used. This decreases flow velocity through the screen and also contributes to significantly lower pressure drops associated with recovery of the cleaning bodies. By going to the open container locations in a cooling water system, as taught herein, separation devices can be placed in the system without the constraints of a conduit, so the cross-sectional area of the recovery screens employing the method of this invention is greater and velocities are correspondingly lower. Preferably, the water velocities through the screening device are kept below about 5 feet per second. At 5 and 6 feet per second flow velocity, head loss is on the order of 1 foot through conventional screening devices of this invention.

Straining or screening devices to be employed in the present invention may be made smaller, lighter weight and more removable or portable than similar screening devices used for intake structures of cooling water systems. This is possible because the open area of the screening devices can be made greater than normally used for intake water, where water-borne debris larger than one quarter inch is normally removed. The hard cleaner bodies of this invention will have a maximum dimension of greater than 0.5 inch, and more often greater than 0.75 inch. Thus, while commercial devices used for intake water structure may be used, advantages may accrue from special design of screening devices for the methods of this invention.

Referring to FIG. 4, riser 22 conveys cooling water having cleaning bodies 200 dispersed therein from a heat exchanger to cooling tower 20. Inlet box 24 provides an open surface of cooling water. Cooling water then continues through distribution piping 22(*a*) to exit through nozzles 22(*b*) and fall through the cells (not shown) of cooling tower 20. The stream of cooling water passes through travelling screen 25 which is moved by sprocket assembly 27. Cleaning bodies are collected in trough 29 for recirculation to a heat exchanger.

Although a travelling screen is illustrated in FIG. 4, it should be understood that any screening device for removing solid bodies from open bodies or containers of water may be employed, as described in the foregoing. For example, a rotary drum screening device may be used in place of a traveling screen. Such devices are available from suppliers which normally supply them for screening intake water for industrial processes.

FIGS. 5 and 6 illustrate use of slanted stationary screen 70 in cooling tower 20. Risers 22 (FIG. 5) convey cooling water having dispersed therein cleaning bodies 200. Cooling water containing bodies 200 passes down distribution conduit 22(*a*) and exits through nozzles 22(*b*), the nozzles being large enough for cooling bodies 200 to pass therethrough. The cooling water and bodies 200 then impinge on slanted screen 70. As shown in the second side view of FIG. 6, cooling water passes through screen 70 into pan 75 and therefrom through the cells of heat exchanger 20 of FIG. 5. Cooling bodies collected on screen 70 are removed by the forces of gravity and water flow along the surface of screen 70 to be recovered in trough 72, from which they are recirculated to a heat exchanger.

Referring to FIG. 7, seal pit 40 is shown, into which cooling water flows through conduit 41 and out of which cooling water flows through conduit 45. Weir 42 insures that water level will remain over inlet conduit 41 at all times. Cleaner bodies 200 are dispersed in the cooling water and are removed by screen 44. Cross-section view across screen 44 is shown in FIG. 8. Screen 44 is shown to be a pivoted rake bar screen, such as discussed heretofore, but other screens such as travelling screens may also the employed.

Figure 10:
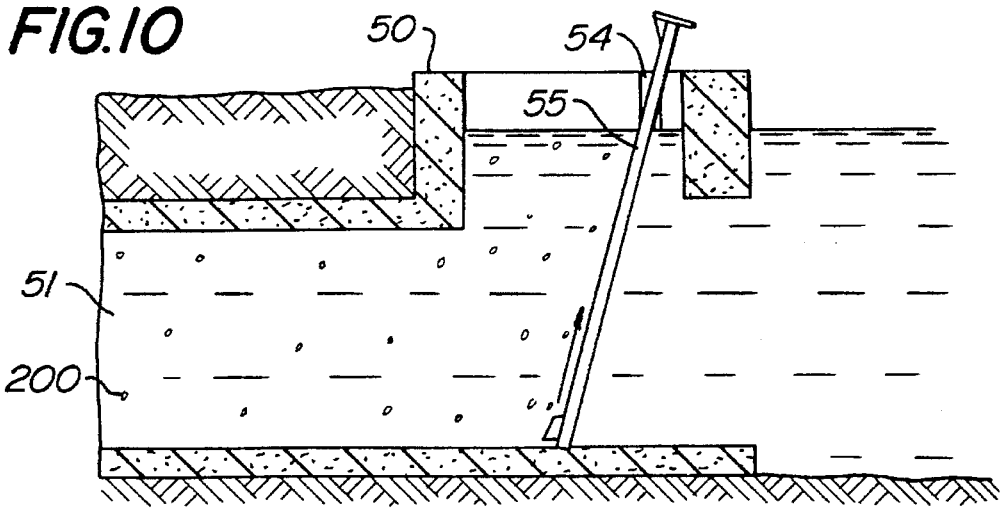
FIG. 10 is a cross-section of one embodiment of the discharge structure and recovery screen of FIG. 9.

In FIG. 9, a plan view is shown of discharge structure 50 for the cooling water from a power plant. Open containers 52 receive water from inlet conduits 51 and discharge water through streams 56. Slots 54 are present in containers 52 such that "stop logs" may be placed in the slots to serve as valves between open containers 52 and streams 56. The incoming cooling water contains cleaner bodies (not shown). Cross-section 10 of FIG. 9 is shown in FIG. 10. Screen 55 is adapted to seal into slots 54. A pivoted rake bar screen is illustrated in FIG. 10, but any screen device for removing bodies from water having an open surface may be used. Cleaner bodies 200 are removed by the screen.

Figure 11:
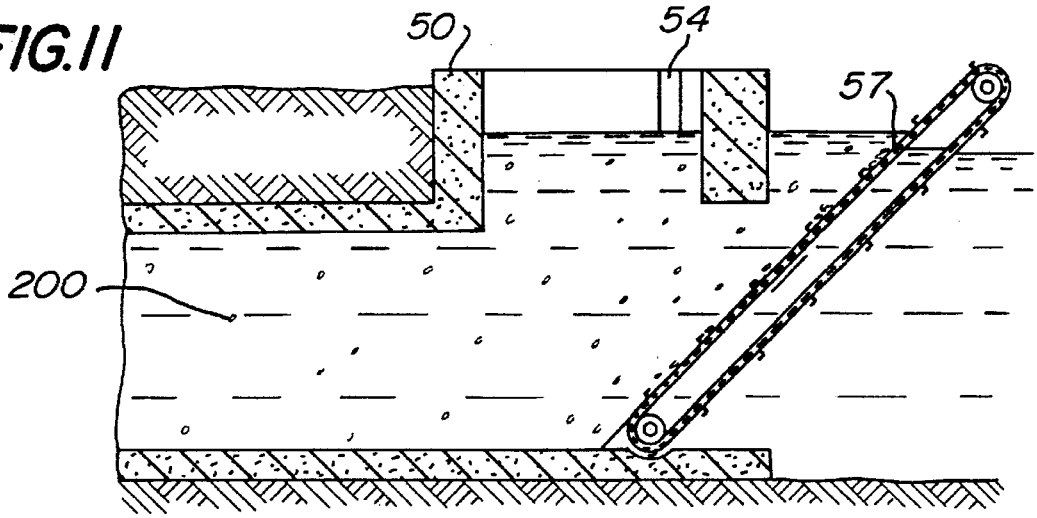
FIG. 11 is a cross-section of an alternate embodiment of a discharge structure and recovery screen.

Referring to FIG. 11, traveling screen 57 is shown adapted to seal at the bottom of outflow structure 50. Cleaner bodies are removed as described heretofore.

In FIG. 12, structure 60, also shown in FIG. 1, is interposed between power plant 10 and a body of water at a lower elevation to which cooling water is flowing. The water may flow over weir 61, shown in FIG. 12. Attached to weir 61 is stationary screen 64. Cooling bodies 200 collect on screen 64 and flow by gravity and the force from water flow along the surface of screen 64 into trough 67, from whence they are recirculated to a heat exchanger. The angle of screen 64 with respect to horizontal is selected to allow cleaning bodies 200 to be removed from the screen effectively. Water flows through screen 64 to a body of water at a lower elevation. Alternatively, cleaning bodies 200 may be removed from screen 64 by rakes or other means of moving solid bodies along screen 64 and into trough 67.

Having described the invention above, various modifications of the techniques, procedures, methods, material and equipment will be apparent to those in the art. It is intended that all such variations within the scope and spirit of the appended claims be embraced thereby.

What is claimed is:

1. Apparatus for removing tube cleaners from cooling water downstream from a heat exchanger, comprising:

a flume for distribution of cooling water around a cooling tower;

screening means for screening the tube cleaners, the screening means having a screen, the screen having an opening size, the screen being placed such that cooling water which enters and leaves the flume pass through the screen; and means for removing the cleaners from the screen.

2. A method for removing tube cleaning bodies from cooling water downstream of a heat exchanger, comprising the steps of:

providing a flume of a cooling tower open to the atmosphere;

placing a screening means for screening the cleaning bodies such that water which enters and leaves the flume passes through the screening means; and providing a means for removing the cleaning bodies from the screen of the screening means.

* * * * *